United States Patent [19]

Randolph

[11] 4,348,964

[45] Sep. 14, 1982

[54] SLIDING SILL LOW FRICTION SUPPORTING PLATE ASSEMBLY

[75] Inventor: Robert W. Randolph, St. Charles, Mo.

[73] Assignee: ACF Industries, Inc., New York, N.Y.

[21] Appl. No.: 189,259

[22] Filed: Sep. 22, 1980

[51] Int. Cl.[3] ..... B61D 17/04; B61F 1/08; B61G 9/20

[52] U.S. Cl. ..... 105/42 D; 213/49; 213/61

[58] Field of Search ..... 105/42 D; 213/80, 49, 213/60, 61

[56] References Cited

U.S. PATENT DOCUMENTS

| | | | |
|---|---|---|---|
| 2,763,380 | 9/1956 | Danielson | 213/49 |
| 3,223,051 | 12/1965 | Peterson | 213/8 X |
| 3,286,659 | 11/1966 | Cunningham | 105/420 |
| 3,329,285 | 7/1967 | Crenshaw | 105/420 X |
| 3,422,772 | 1/1969 | Stark | 105/420 X |
| 3,492,950 | 2/1970 | Cale | 105/420 |
| 4,133,434 | 1/1981 | Chierici | 213/60 |
| 4,264,015 | 4/1981 | Mathiew | 105/420 X |

*Primary Examiner*—Robert B. Reeves
*Assistant Examiner*—Howard Beltran
*Attorney, Agent, or Firm*—Henry W. Cummings

[57] ABSTRACT

A fixed sill includes a pair of lower, outwardly extending fixed sill flanges. A generally vertical longitudinally extending support plate is integrally connected to each fixed sill flange on each side of the fixed sill. A sliding sill support is rigidly connected to each support plate. The sliding sill support includes a horizontal inwardly extending portion that also extends longitudinally inboard. The sliding sill support is located slightly below the fixed sill flange. A pair of low friction wear plates are adopted to be slipped in place upon each sliding sill support. The low friction wear plates include horizontal body portions on each side of the fixed sill upon which the sliding sill rides in moving back and forth. Each wear plate includes "U" shaped end portions which wrap around in the inner and outer ends of the sliding sill support. The wear plate is made of resilient material having a low coefficient of friction with steel and good strength in compression to withstand the load of the sliding sill.

7 Claims, 4 Drawing Figures

SLIDING SILL LOW FRICTION SUPPORTING PLATE ASSEMBLY

BACKGROUND OF THE INVENTION

In a center of car cushioned (sliding sill) railroad car, especially box cars, the structure includes a fixed center sill inside of which suitably supported and engaged with a cushion unit is a sliding sill. The cushion unit is located at the longitudinal center line of the car and is connected through the fixed sill and sliding sill in such fashion as to allow cushioned longitudinal movement of the sliding sill under impact and train action conditions. See U.S. Pat. Nos. 2,763,380, 3,223,051 and 3,286,659.

The sliding sill is supported at the cushion unit at its center and by supporting members at its ends which allow such longitudinal motion. In normal practice the surfaces of the sill and supporting members may or may not be equipped with hardened steel wear plates to resist wear due to the longitudinal motion of the sliding sill.

It is the purpose of this invention to provide an easily replaced low coefficient of friction, wear resistant material in this area to reduce wear and increase the life of the support members and the sliding sill.

Use of this material will selectively limit the wear to the low coefficient of friction material and reduce wear on the sliding sill to negligable limits.

In U.S. Pat. No. 2,763,380 movable center sills are supported on metallic blocks which are supported on a plate which extends transversely below the fixed sill and longitudinally below the draft gear pocket.

In U.S. Pat. No. 3,223,051 the sliding sill is supported by metal wear strips which engage metal wear strips on the sliding sill (FIGS. 7 and 13). The sliding wear strip is welded to a depending channel from the sliding sill.

In U.S. Pat. No. 3,286,659 the sliding sill is supported by wear plates located on the fixed sill which engage angles welded to the movable sill outboard of the bolster. Inboard of the bolster the sliding sill is supported by wear plates located on upstanding bases integral with the fixed sill. In this arrangement the angles welded to the movable sill add to the construction costs.

In all of the above arrangements the metal on metal contact between the fixed sill supports and the movable sill engaging members results in a high coefficient of friction between the fixed and movable sills.

Also replacement of the abutting metallic wear plates requires dissembly of the movable sill from the fixed sill. The car thus must be taken out of service, and the cost of welding in new wear plates is a significant disadvantage.

In U.S. Pat. No. 4,133,434 a snap-on coupler carrier wear plate made of ultra-high molecular weight polyethylene is disclosed.

However this patent does not disclose structure to adapt the ultra-high molecular weight polyethylene to a coupler wear plate for use in supporting a movable center sill.

IN THE DRAWINGS

SUMMARY OF THE INVENTION

Figure 1:
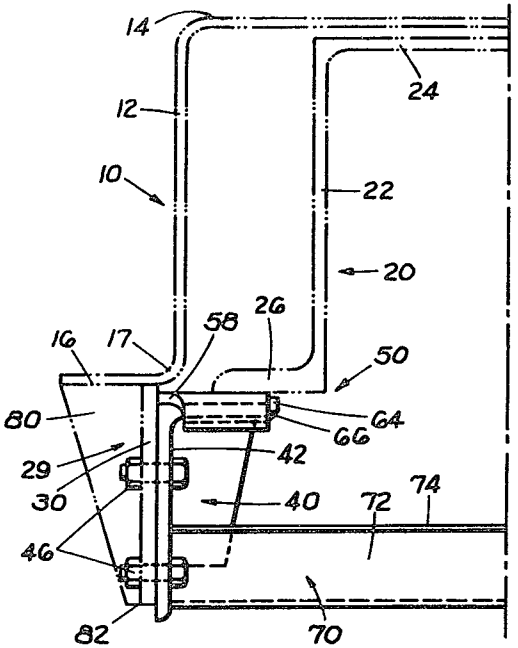
FIG. 1 is a front elevation view of one half of the sliding sill support plate arrangement of the present invention.
Figure 4:
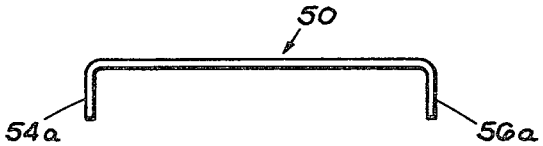
FIG. 4 is a detail view of an alternate wear plate end portion in accordance with the present invention.

The object of the present invention is to provide an arrangement for supporting a sliding center sill upon a pair of slip-on low friction material center sill wear plates.

A fixed center sill includes a pair of lower, outwardly extending fixed sill flanges. A generally vertical, longitudinally extending support plate is integrally connected to each fixed sill flange on each side of the fixed sill. A sliding sill support is rigidly connected to each support plate. Each sliding sill support includes a horizontal extending portion that extends transversely inwardly and longitudinally inboard. Each sliding sill support is located slightly below the fixed sill flange. A pair of low friction material wear plates are adopted to be slipped in place upon the sliding sill supports. The wear plates include horizontal body portions on each side of the fixed sill upon which the sliding sill rides in moving back and forth. Each wear plate includes engagement means which wrap around the inner and outer ends of the sliding sill support. The wear plate is made of resilient material having a low coefficient of friction with steel and good strength in compression to withstand the load of the sliding sill.

Connection openings are provided in the sliding sill support to attach the sliding sill support to the depending support. The sliding sill supports are conveniently angle shaped with the wear plates engaging the upper leg of the angle.

Preferably a transverse member joins the sliding sill supports. This transverse member is conveniently a Z section which is rigidly attached on both ends to the sliding sill supports.

DESCRIPTION OF PREFERRED EMBODIMENTS

A fixed sill 10 extending throughout the length of the car includes vertical web portions 12 and an upper horizontal transverse portion 14. The fixed sill further includes flange portions 16 extending longitudinally of the car. A sliding sill 20 of known construction includes vertical web portions 22 and a top portion 24 which joins the vertical web portions. Flange portions 26 are located at the base of each web portion 22.

Figure 2:
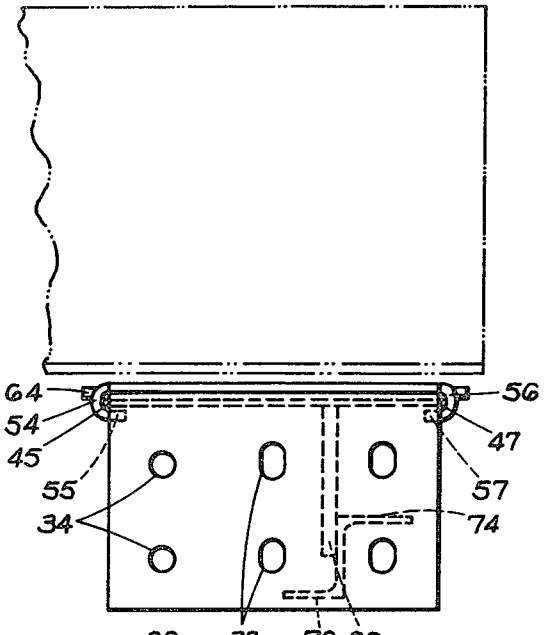
FIG. 2 is a side elevation view of FIG. 1 with the fasteners removed.

In accordance with the present invention a sliding sill support assembly is provided to allow longitudinal movement of the movable sill 20 relative to the fixed sill 10. This assembly 29 includes a pair of depending supports 30 welded to flange portions 16 of the fixed sill adjacent the juncture 17 between the web portion 12 and the flange portion 16. As shown in FIG. 2, the support 30 extends longitudinally inboard of the car. Plate 30 includes a plurality of openings 32 and is generally rectangular in shape.

A sliding sill support plate 40 is located inboard of plate 30 and also extends inboard of the car. Sliding sill support plate 40 includes a plurality of openings 42 adopted to align with the openings 32 in plate 30. Fasteners 46 may thus be inserted to hold the support 40 in engagement with depending plate 30. Plate 40 is an angle and includes an upper leg 48. Upper leg 48 is spaced below flange 16 of the fixed sill a suitable distance to allow attachment of a wear plate 50.

Figure 3:
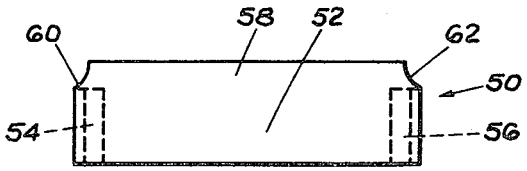
FIG. 3 is a detail plan view of the wear plate used in the present invention.

As shown in FIG. 3, wear plate 50 includes an upper surface 52 adopted to support the flanges 26 of the sliding sill 20. In the preferred embodiment, the wear plate 50 includes means for engaging the ends 46 and 47 of the sliding sill support 40. This engagement means includes bent end portions 54 and 56 which are generally "U" shaped (FIG. 2) and include inner ends 55 and 57 which extend below horizontal portion 48. As shown in FIG. 2, the inner end portion 58 of the wear plate abuts the depending plate 30 as shown in FIG. 1. At either end the portion 58 includes a cutout portion 60 and 62.

The wear plate 50 is made of a material having a low coefficient of friction with steel. In addition the material for wear plate 50 should have sufficient strength in compression to carry the loads of sliding sill member 20. In the preferred embodiment the wear plate 50 should be dimensioned such that the "U" shaped portions 54 and 56 will engage the ends of leg 48. Furthermore the material for wear plate 50 should have sufficient resiliency that when properly dimensioned it can be made to slide into place upon horizontal portion 48 as shown in FIGS. 1 and 2. Thereafter it is secured in place by welding retainer 64 in FIG. 1 at 66.

Alternatively, wear plate 50 may be provided with end portions 54*a* and 56*a* which extend vertically and engage only the ends of sliding sill support 40. Retainer 64 is welded in.

Suitable low friction materials for this purpose will be apparent to those skilled in the art. An example of a suitable material is untra-high molecular weight polyethylene sold under the tradename "Ultra-wear" marketed by the Polymer Corporation of Reading, Pa. A brochure describing this material is available in the application file. Other appropriate low friction materials will be apparent.

The low coefficient of friction with steel enables the sliding sill member 20 to move relative to the fixed sill much more easily than with the prior art metal to metal arrangements.

A member 70 extends between the sliding sill supports 40. This transversely extending member 70 is conveniently a "Z" section having a vertical web portion 72, an upper horizontal leg 74 and a lower leg 76. Member 70 is welded to the lower end of depending support 40.

In addition gussets 80 are preferably provided extending downwardly from fixed sill flange portions 16 and welded to depending support 30.

It is seen that the present invention has the following advantages. (1) The lower coefficient of friction between the sliding sill 20 and the wear plate 50 enables movement of the sliding sill much more easily than where metal to metal contact occurs as in prior constructions; (2) Longer life due to improved lower coefficient of friction and bearing properties of plastic material; (3) Wear is confined to wear plate; wear on the sliding sill 20 is negligable; (4) The wear plate 50 is readily replaced by removing retainer 64 by removing the weld 66 and sliding the wear plate 50 out of engagement with sliding sill support 48. A new wear plate 50 is easily inserted and retainer 64 replaced and secured by replacing weld 66. (5) The plastic material used for wear plate 50 is considerably less expensive to replace than a corresponding steel wear plate.

What is claimed is:

1. A low friction sliding sill support assembly comprising: a fixed sill including a pair of lower, outwardly extending fixed sill flanges; a generally vertical longitudinally extending support plate integrally connected to each fixed sill flange on each side of the fixed sill; a separate longitudinally extending sliding sill support rigidly connected to each support plate; each said sliding sill support also including a horizontal portion that extends transversely inwardly of the car; said sliding sill supports being spaced apart and located below said fixed sill flanges; a pair of low friction material wear plates adopted to be slipped in place upon said sliding sill supports; said wear plates including horizontal body portions on each side of the fixed sill upon which the sliding sill rides moving back and forth relative to said fixed sill; each wear plate including means for engaging the inner and outer ends of its respective sliding sill support; said wear plates being made of resilient material having a low coefficient of friction with steel; and good strength in compression to withstand the longitudinal movement of the sliding sill.

2. A low friction sliding sill support assembly according to claim 1, wherein said engagement means comprise "U" shaped end portions which wrap around said inner and outer ends of said sliding sill supports.

3. A low friction sliding sill support assembly according to claim 1, wherein said engagement means comprise downward turned flanged end portions which extend below said inner and outer ends of said sliding sill support.

4. A low friction sliding sill support assembly according to claim 1, wherein fastener openings are provided in said sliding sill supports to attach said sliding sill supports to said vertical supports.

5. A low friction sliding sill support assembly according to claim 1, wherein said sliding sill supports are angle shaped with said wear plates engaging respectively the upper leg of the angle.

6. A low friction sliding sill support assembly according to claim 1, wherein a transverse support joins said sliding sill supports together.

7. A low friction sliding sill support assembly according to claim 6, wherein said transverse support comprises a Z section which is rigidly attached on both ends to said sliding sill supports.

* * * * *